US007950569B2

(12) United States Patent
Goldman et al.

(10) Patent No.: US 7,950,569 B2
(45) Date of Patent: May 31, 2011

(54) CONTAINER FOR FOOD

(75) Inventors: Neil Goldman, Flitwick (GB); Frank Mills, Flitwick (GB); Philip Wright, Flitwick (GB)

(73) Assignee: Colpac Limited, Bedfordshire (GB)

( * ) Notice: Subject to any disclaimer, the term of this patent is extended or adjusted under 35 U.S.C. 154(b) by 384 days.

(21) Appl. No.: 11/989,490

(22) PCT Filed: Jul. 28, 2006

(86) PCT No.: PCT/GB2006/002850

§ 371 (c)(1),
(2), (4) Date: Jul. 15, 2008

(87) PCT Pub. No.: WO2007/012880

PCT Pub. Date: Feb. 1, 2007

(65) Prior Publication Data

US 2010/0127054 A1 May 27, 2010

(30) Foreign Application Priority Data

Jul. 29, 2005 (GB) ..... 0515677.3
Mar. 6, 2006 (GB) ..... 0604490.3

(51) Int. Cl.

| | |
|---|---|
| ***B65D 5/36*** | (2006.01) |
| ***B65D 5/66*** | (2006.01) |
| ***B31B 5/26*** | (2006.01) |
| ***B31B 1/26*** | (2006.01) |

(52) U.S. Cl. ..... 229/115; 229/117.01; 229/186; 493/121; 493/162

(58) Field of Classification Search ..... 229/115, 229/117.01, 117.05, 117.06, 117.07, 117.08, 229/186; 206/551; 493/121, 128, 152, 153, 493/162, 167

See application file for complete search history.

(56) References Cited

U.S. PATENT DOCUMENTS

| | | | | |
|---|---|---|---|---|
| 695,557 | A * | 3/1902 | Houghland | 229/115 |
| 1,933,643 | A * | 11/1933 | Tanner | 229/115 |
| 2,349,589 | A * | 5/1944 | Harrington | 229/115 |
| 2,421,748 | A * | 6/1947 | Fink | 229/115 |
| 3,006,527 | A * | 10/1961 | Lofquist, Jr. | 229/115 |
| 3,653,576 | A * | 4/1972 | Stranicky | 229/115 |
| 4,798,323 | A * | 1/1989 | Platt | 229/117.01 |
| 5,522,538 | A * | 6/1996 | Gray | 229/186 |
| 6,431,365 | B1 | 8/2002 | Money | |

FOREIGN PATENT DOCUMENTS

| | | |
|---|---|---|
| DE | 29903316 | 6/1999 |
| GB | 2321236 | 7/1998 |
| GB | 2398557 | 8/2004 |

* cited by examiner

*Primary Examiner* — Gary E Elkins
(74) *Attorney, Agent, or Firm* — Dykema Gossett PLLC

(57) ABSTRACT

A container for receiving a food product is formed from a shaped blank of paper, paperboard, cardboard or a similar material. A hinge arrangement comprising at least two and preferably three parts is provided between one of the side walls and one of the end walls to allow the partially formed container to be moved easily between a flat configuration suitable for transportation or storage and an erect configuration for receiving a food product. In the erect configuration one part of the hinge arrangement is sandwiched between another part of hinge arrangement and the end wall. In the flat configuration these two parts of the hinge arrangement lie in substantially the same plane. An integral lid may be provided.

14 Claims, 15 Drawing Sheets

CONTAINER FOR FOOD

This invention relates to a container for receiving a food product and in particular the invention is concerned with containers that can be formed by folding a shaped blank of paper, paperboard, cardboard or a similar material.

This invention provides a partially assembled container for receiving a food product and formed from a blank, the container having triangular side walls and substantially rectangular end walls to enable the formation of a generally triangular prism-shaped container with an opening for receiving the food product, wherein hinge means comprising a first hinge part hingedly connected to a second hinge part are provided between one of said side walls and one of said end walls to enable the partially assembled container to be moved between a substantially flat position for storage and transportation and a substantially erect position for receiving a food product.

This novel container construction provides a partially formed container that has a number of advantages over known constructions. In particular it can be moved quickly and easily between a flat configuration to an erect configuration without the need for tabs or tongues to be inserted in pre-cut slots or additional gluing. The container "pops up" from the flat configuration to the erect configuration when the sides of the flat container are pulled apart. Also, the partially formed container makes very efficient use of the blank material, thereby decreasing costs. Further, the partially formed container can be transported in the flat condition, and then erected easily by the food producer.

In one embodiment the first hinge part is hingedly connected to said one side wall, and the second hinge part is rigidly connected to said one end wall. The first and second hinge parts lie in substantially the same plane when the container is in a substantially flat condition, and the first hinge part and said one end wall sandwich the second hinge part when the container is in a substantially erect condition.

In another embodiment the hinge means additionally comprises a third hinge part hingedly connected to the second hinge part and rigidly connected to the said end wall. Preferably, the third hinge part is hingedly connected to the second hinge part and rigidly connected to the said end wall such that the said end wall is sandwiched by the second and third hinge parts. In a first preferable alternative, the third hinge part is hingedly connected to the second hinge part and rigidly connected to the said end wall such that the said third hinge part is sandwiched by the end wall and the second hinge part. In a second preferable alternative, the third hinge part is hingedly connected to the second hinge part and rigidly connected to the said end wall, and the first hinge part is securely fastened to one of said triangular side walls when the container is in its substantially erect position provision.

The provision of the third hinge part complicates the construction of the container slightly, but its provision is advantageous because it improves the integrity of the seal between the second hinge part and the said end wall to improve the shelf life of the food product contained in the finished container.

The third hinge part and the surface of the end wall to which it is connected may substantially congruent so that the third hinge part of the hinge means and the said end wall provide a basal surface for the container with double thickness. This double thickness basal surface helps to prevent or delay leakage for the contents of the food product from the container.

The hinge means are preferably integral with the said side wall. This feature simplifies the blank from which the partially formed container is constructed, and it helps to improve the integrity of the finished container.

The partially assembled container according to the first and second preferable alternatives is particularly suited to a relatively automated process where the container is opened by machinery provided for that purpose such that a food product can then be inserted manually or by further machinery, and this development is realized by adopting a two stage construction process in which:

1) the third hinge part is fastened to the said end wall and the partially fastened container is folded into a substantially flat configuration;
2) the partially fastened container is stored and transported to a food producer or user;
3) the partially fastened container is opened; and
4) the container is erected by bringing the hinge parts into abutment, or by securing the first hinge part to one of the triangular side walls and then securing the hinge parts in the abutting configuration.

The partially fastened container described in step (i) is suitable for transportation and storage prior to use. The partially fastened container can be folded quickly and easily by apparatus provided for that purpose and then the container can be secured in its erect condition ready for receipt of a food product by fastening the first and second hinge parts as described in step (iii). The configuration of the partially formed container allows steps (ii) and (iii) to be accomplished at high production speeds on known forms of folding and fastening apparatus, or apparatus of that type with simple and inexpensive modifications. These benefits are achieved because the partially fastened container lies flat, making it easier for the machinery to pick and denest it.

It is preferred in the first preferable alternative that the third hinge part is secured to the inner face of the end wall, such that the end wall and the first hinge part sandwich the second and third hinge parts. In this configuration the sandwich pack provides four blank external faces and this simplifies printing onto those external surfaces with advertising, nutritional information or other matter.

Overall the combination of these features allow a container to be formed from a blank with very minimal scoring of the joints to provide a good shelf life performance, and also enable the partially assembled container to be made up easily into a flat configuration for transportation and storage and opened equally easily into an erect configuration for insertion of a food product. The preferred three part hinge arrangement provides an excellent seal and extended shelf life for the food product, but a two part hinge arrangement would also be possible and might be used where the shelf life of the food product is not a crucial factor.

The present invention also provides a blank for forming a container for receiving a food product, the blank having triangular side walls and substantially rectangular end walls to enable the formation a generally triangular prism-shaped container with an opening for receiving the food product, the blank further comprising hinge means, the hinge means comprising a first hinge part hingedly connected to a second hinge part and arranged between one of said side walls and one of said end walls to enable a partially assembled container formed from the blank to be moved between a substantially flat position for storage and transportation and a substantially erect position for receiving a food product.

A clear understanding of the present invention will be gained from the following detailed description, given by way of example only, with reference to the accompanying drawings, in which.

Figure 1:
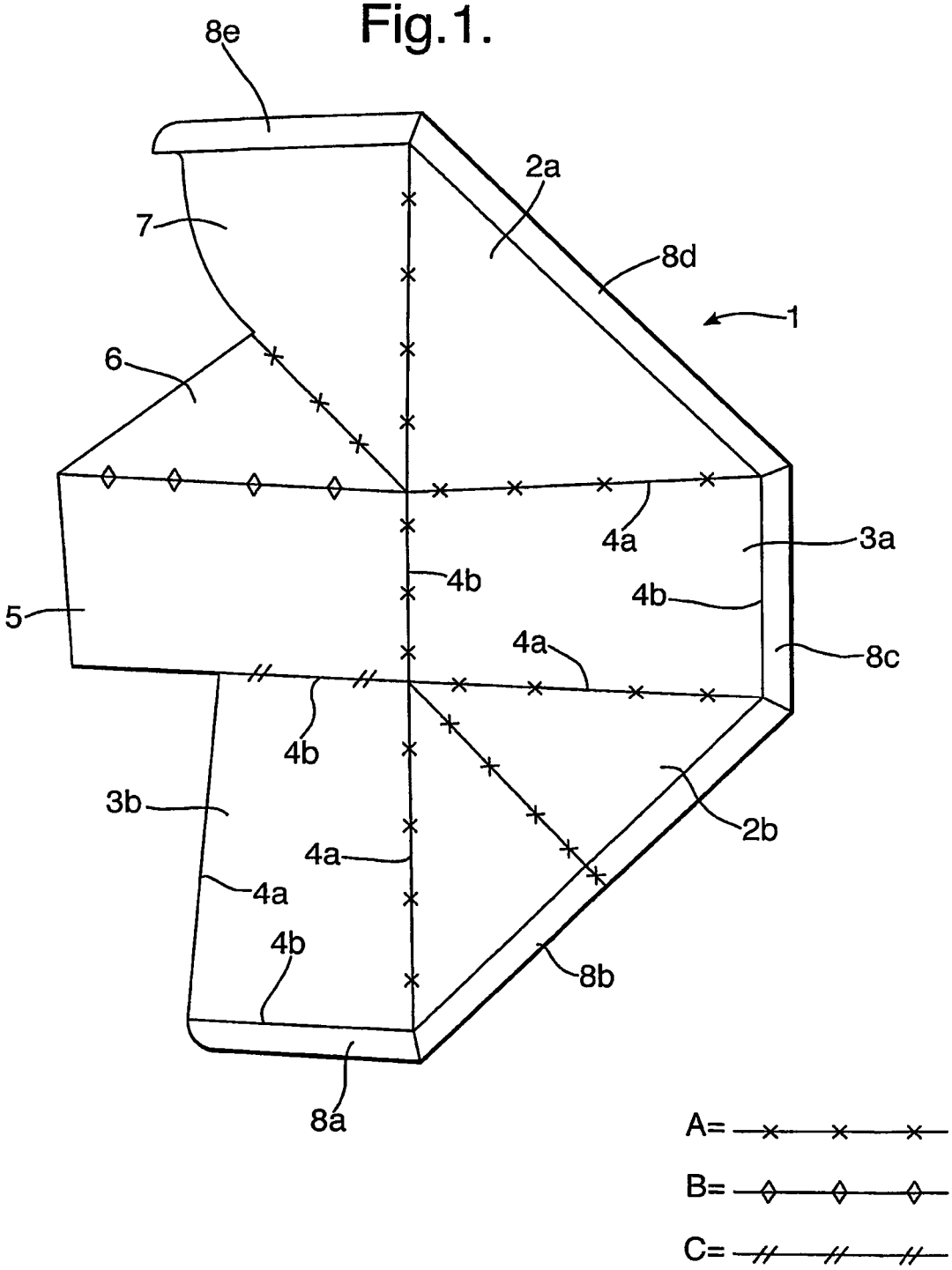
FIG. 1 is a plan view of a container according to the invention.

The container blank or skillet shown in FIG. 1, and generally designated 1, may consist of paper, paperboard, cardboard or a similar material. A pair of congruent isosceles-shaped side walls 2*a* and 2*b* are alternately arranged with and hingedly connected to generally rectangular end walls 3*a* and 3*b*. (The end walls may be rectangular, but they are preferably trapezoidal so that in the fully assembled container they taper inwardly towards an apex to allow a number of assembled containers to be stacked together.)

The end walls have opposed major and minor edges, designated 4*a* and 4*b* respectively. Both of the major edges 4*a* of the end walls 3*a* are flanked by the congruent edges of the side walls 2*a* and 2*b*. Side wall 3*b* has one of its major edges 4*a* integrally formed with a congruent edge of side wall 2*b*.

A hinge arrangement integrally formed with side wall 2*a* has three parts: generally rhombic flap or tab 5; a triangular central part or panel 6; and a three sided part or panel 7. These three parts are integrally formed and connected by fold lines. Panel 7 is integrally formed with side wall 2*a*. The flap 5 is hingedly connected to the minor edge 4*a* of end wall 3*a* and this hinge point forms the apex of the finished triangular prism-shaped container.

All of the connecting lines shown in FIG. 1 represent valley or hill folds with valley folds shown with icon A and hill folds shown with icon B. Icon C shown between flap 5 and end wall 3*a* represent a cut line.

Oral flaps or tabs 8*a* to 8*e* formed with side walls 2, the end walls and the panel 7 cooperate in the assembled container to define a flange which is surrounds the mouth 9 of the container.

Figure 2:
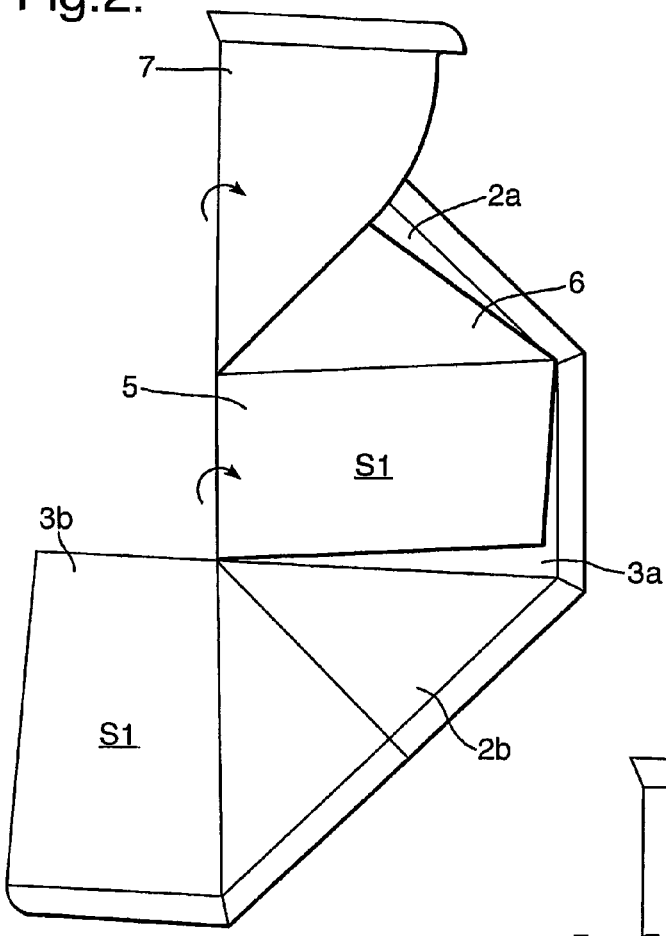
FIGS. 2 and 3 are plan views of the blank in an intermediate stage of construction.
Figure 3:
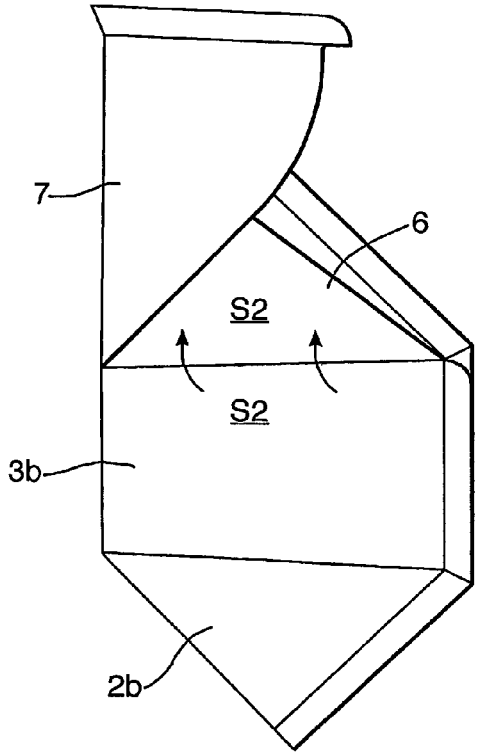

Turning now to FIG. 2, the hinge arrangement 5,6,7 is folded to overlie the side and end walls 2*a*, 3*a*. End wall 3*b* is then brought into abutment with the exposed surfaces of the flap 5 by folding the side wall 2*b* about its central fold line as shown in FIG. 3. The abutting surfaces of the flap 5 and the end wall 3*b*, both designated as S1 in FIG. 2, are glued together to form a permanent join. These surfaces S1 are substantially (but not completely) congruent to form a double thickness wall. This double thickness wall can be used as the base on the finished container to provide addition resistance against the egress of the food product housed within the container.

Figure 4:
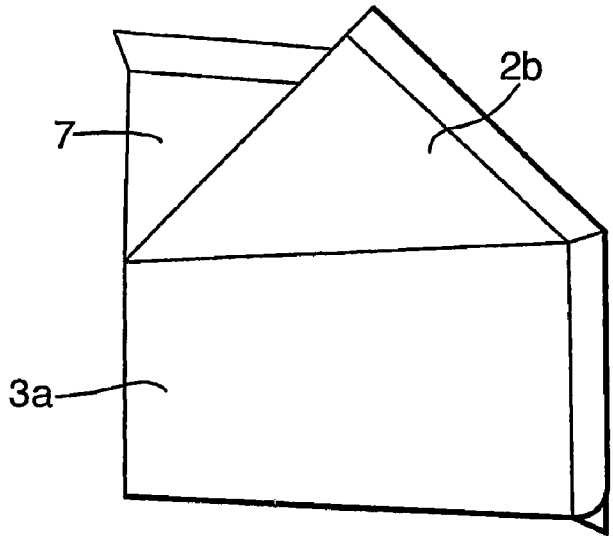
FIG. 4 is a plan view of a partially assembled container in a flat configuration.

As shown in FIG. 3, the blank is further folded about the join between the tab 5 and the central panel 6 to bring part of the end wall 3*b* into abutment with the exposed surface of the central panel 6. The abutting surfaces of the first element 6 and the end wall 3*b*, both designated as S2 in FIG. 3, are glued together to form a permanent join and thereby sandwich part of the end wall 3*b* between the flap 5 and the central panel 6. The resultant partially formed container is shown in FIG. 4, and this configuration represents the partially formed container in its flat configuration.

Figure 5:
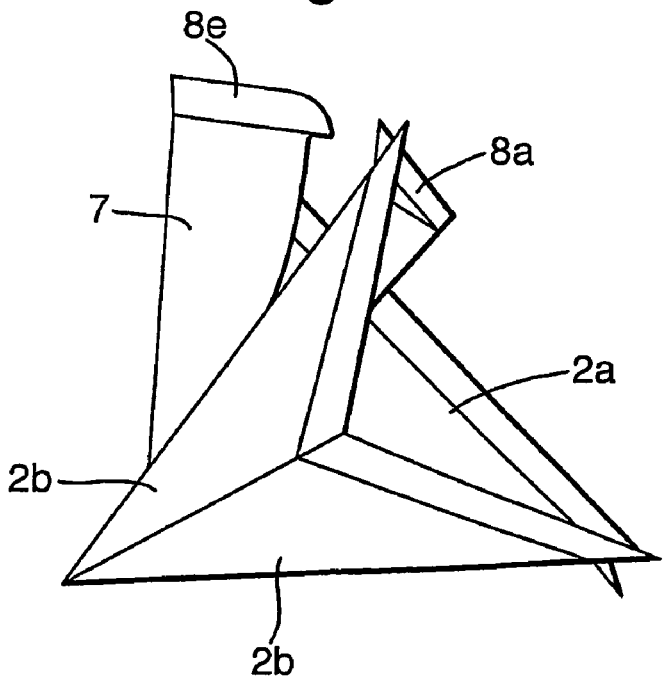
FIGS. 5 and 6 are perspective views of a partially assembled container between a flat configuration and an erect configuration.
Figure 6:
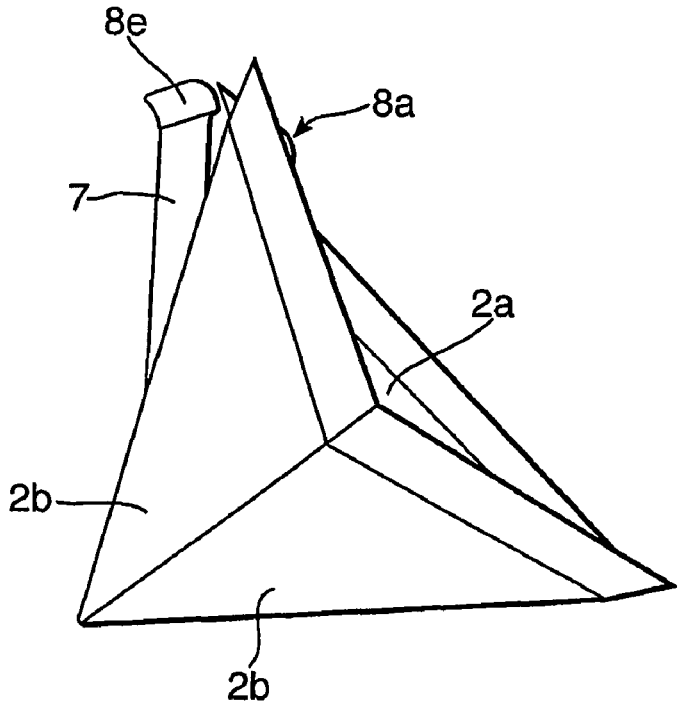
Figure 7:
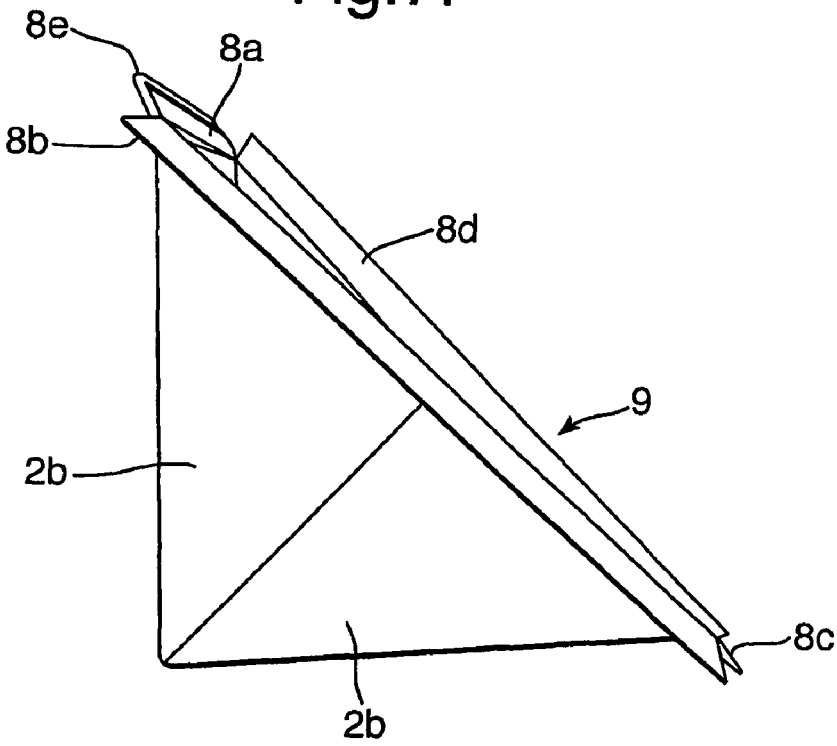
FIGS. 7 and 8 are perspective views of a partially assembled container in an erect configuration.
Figure 8:
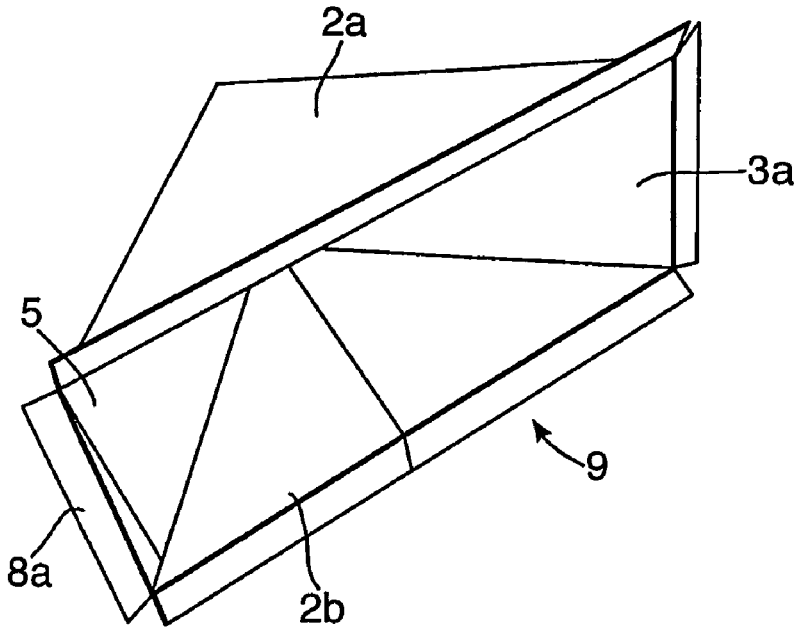
Figure 9:
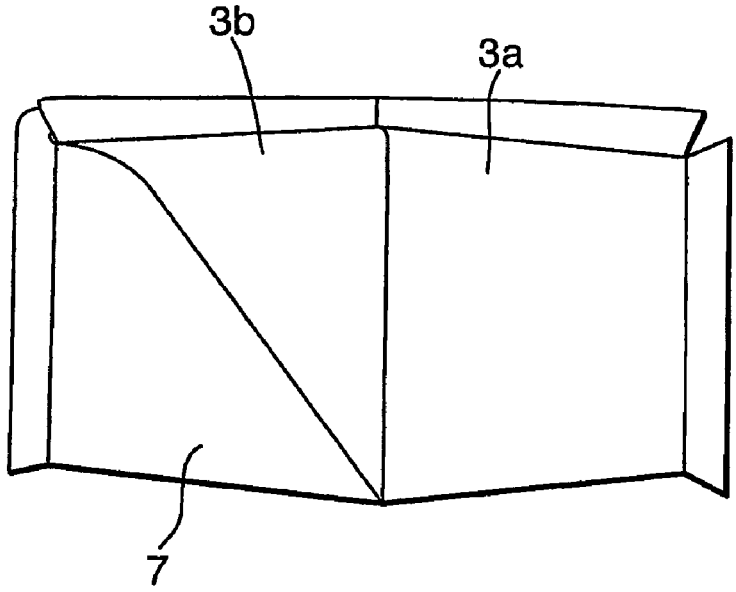
FIG. 9 is an underside view of the partially assembled container of FIGS. 7 and 8.

The configuration of the container means that when it is opened by, say, pulling the side walls 2*a* and 2*b* in opposite directions, the container naturally opens out into an erect configuration ready for receiving a food product, such as a sandwich. The movement of the container between the flat configuration shown in FIG. 4 and the erect configuration shown in FIG. 7 is depicted, as far as it is possible to do so, in FIGS. 5 and 6.

In the erect configuration the panel 7 and the end wall 3*b* sandwich the central panel 6, and the container can be fixed in a fully formed configuration by permanently joining the abutting parts of these panels 6,7. Alternatively, or in addition, part of the panel 7 will abut the part of the end wall 3*b* and the container can be fixed in a fully formed condition by joining these abutting surfaces. In an alternative embodiment a catch or detent mechanism can be provided so that the partially assembled container can be mechanically fastened in an erect condition without the use of glue or other permanent fastening.

The oral flanges 8*a* and 8*e* overlap in the erect configuration and these may also be glued or otherwise fastened together. Alternatively one of these flanges could be omitted from the blank.

The preferred embodiment of the invention, which is depicted in FIGS. 1 to 9 and described above, has a hinge arrangement made up from three parts. However, it will be apparent to a person skilled in the art that a two piece hinge arrangement made up from the panel 7 and the central panel 6 would function in the same manner. The use of the flap 5 is advantageous because it improves the integrity of the seal between the hinge arrangement and the end wall 3*b*, and it also provides a double thickness basal surface in the finished container, but if the shelf life of the food product does not need to be maximized then the flap 5 could be omitted to reduce the amount of material used in the blank.

Figure 10:
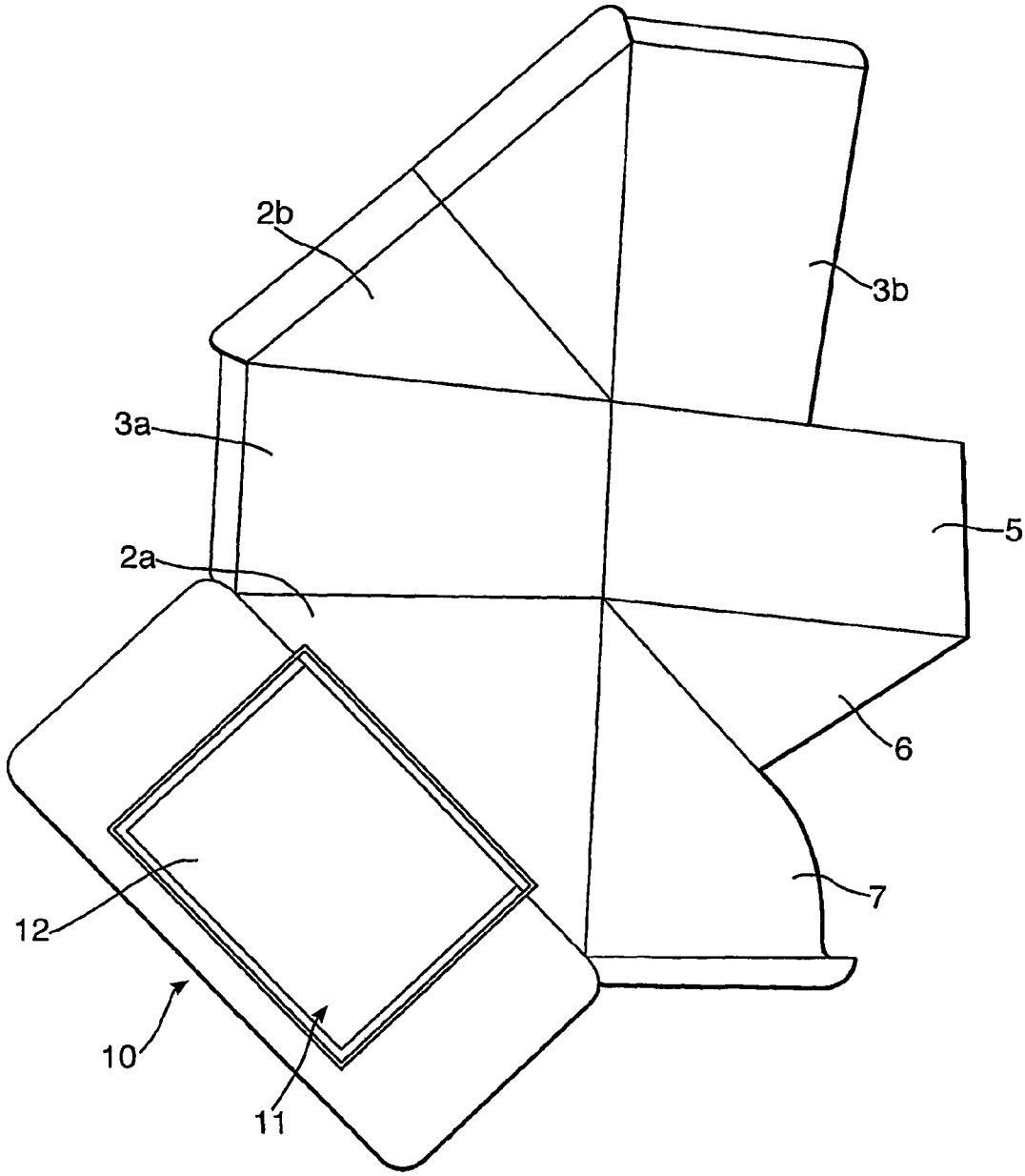
FIG. 10 is a plan view of a blank according to a second embodiment of the invention with an integral lid.
Figure 11:
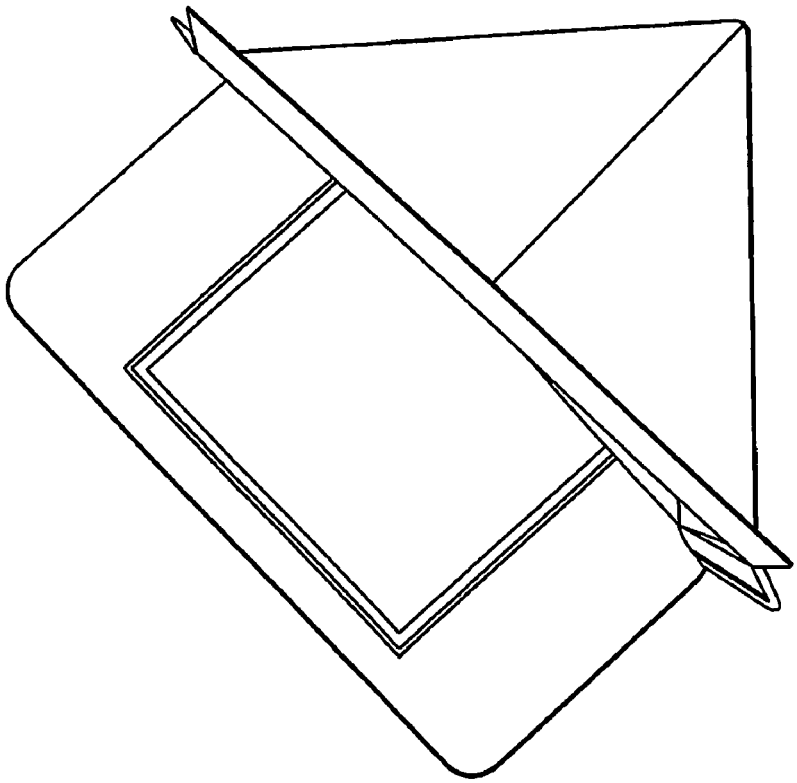
FIGS. 11 and 12 are perspective and underside views respectively of the blank shown in FIG. 10 assembled into a container, with FIG. 11 showing the lid open and FIG. 12 showing the lid closed.
Figure 12:
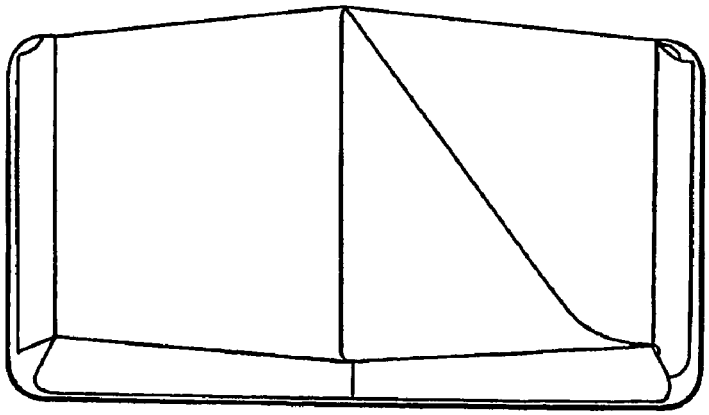
Figure 13:
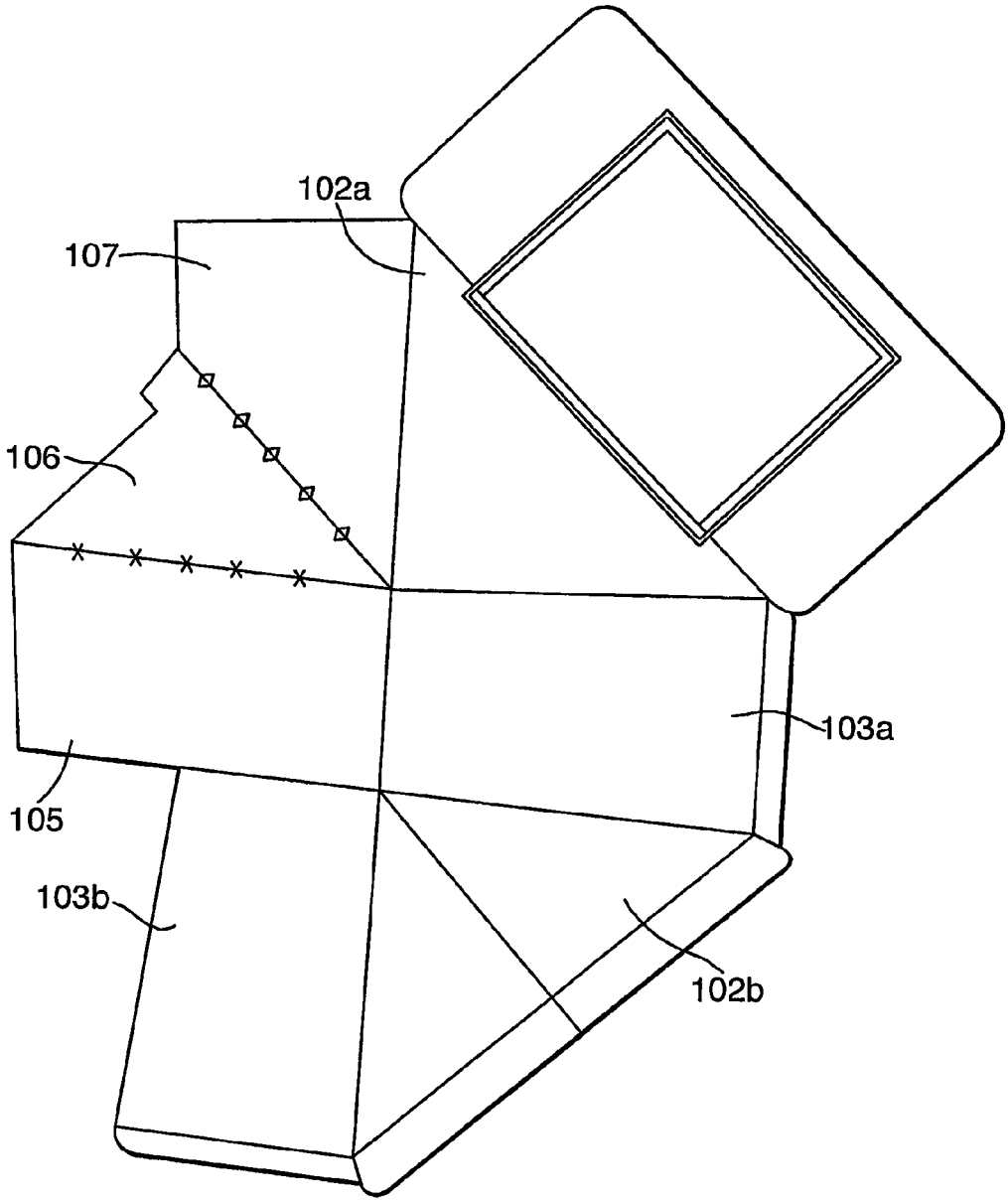
FIG. 13 is a plan view of a container according to third embodiment.
Figure 14:
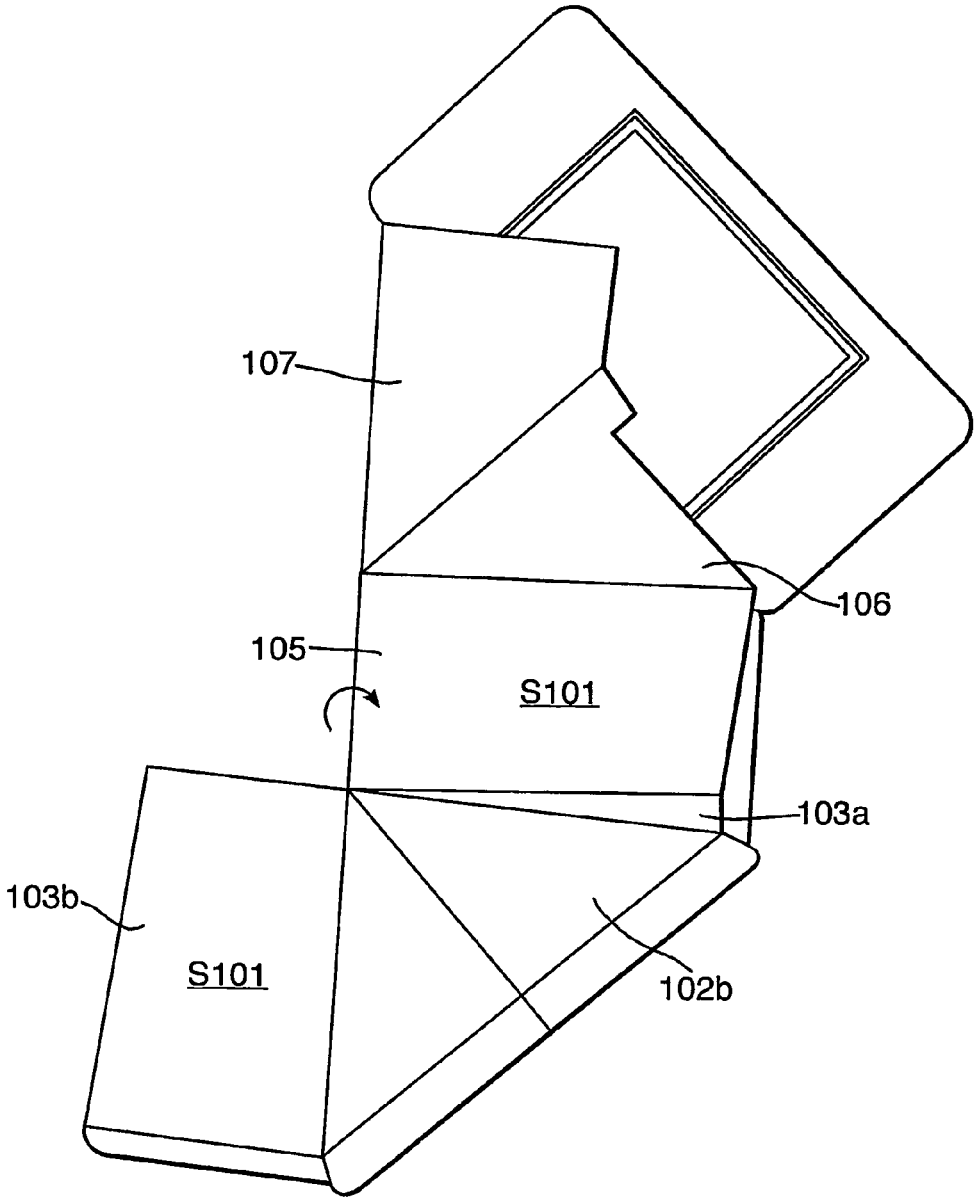
FIGS. 14, 15 and 16 are views of the blank shown in FIG. 13 in an intermediate stage of construction.
Figure 15:
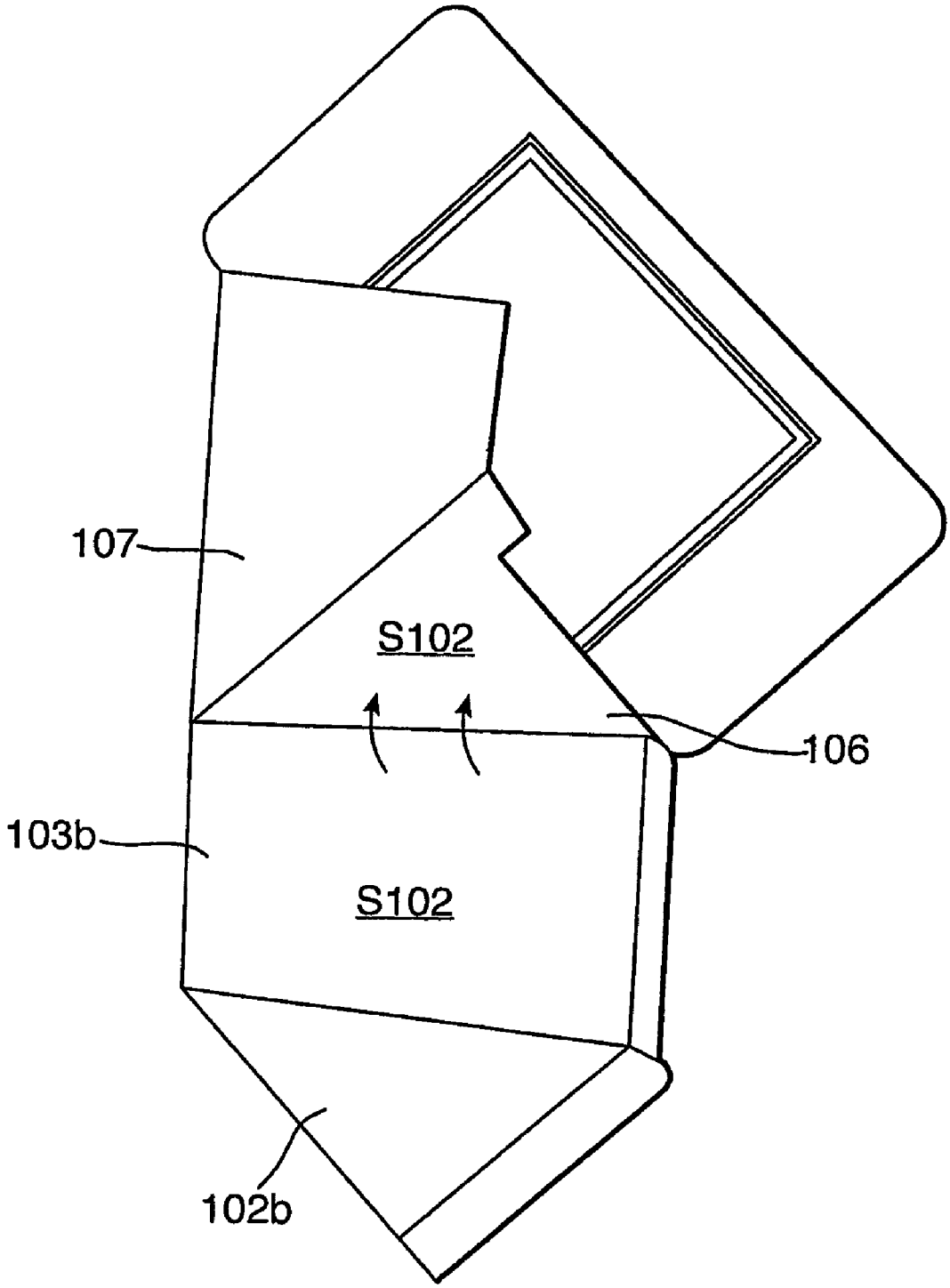
Figure 16:
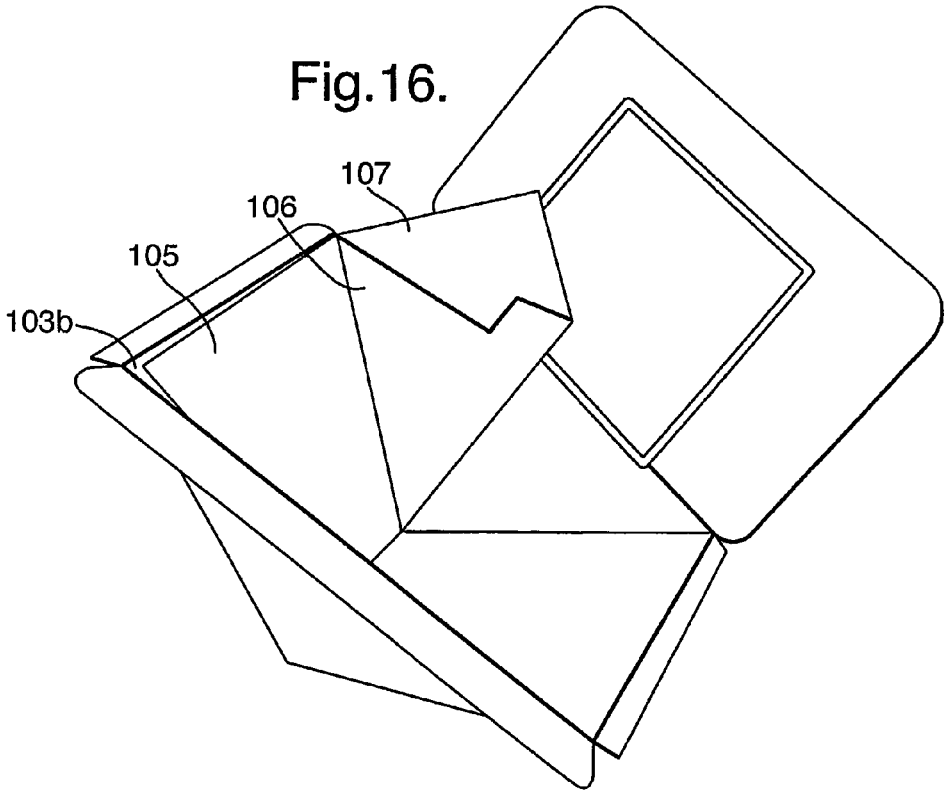
Figure 17:
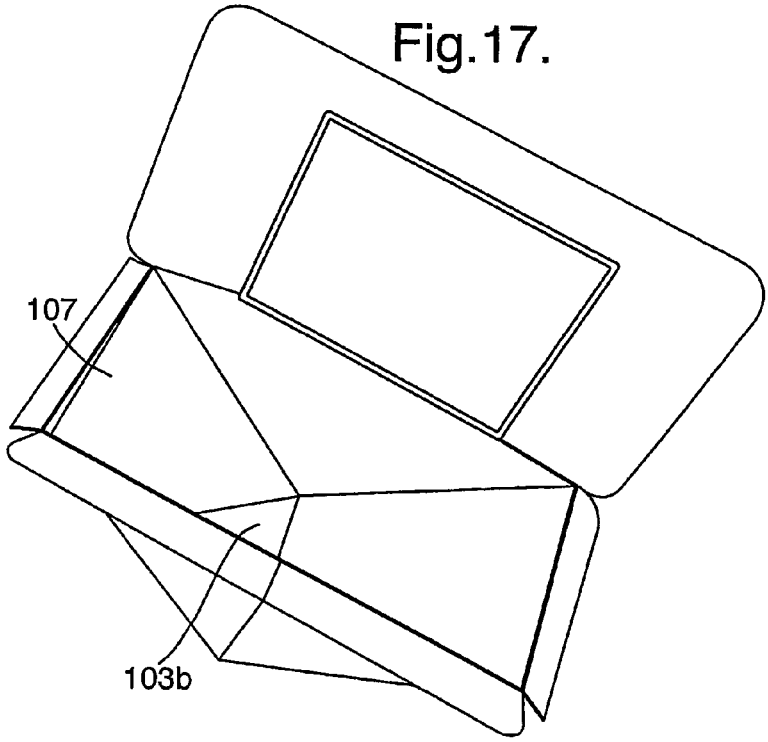
FIG. 17 is a perspective view of a partially assembled container in an erect configuration.
Figure 18:
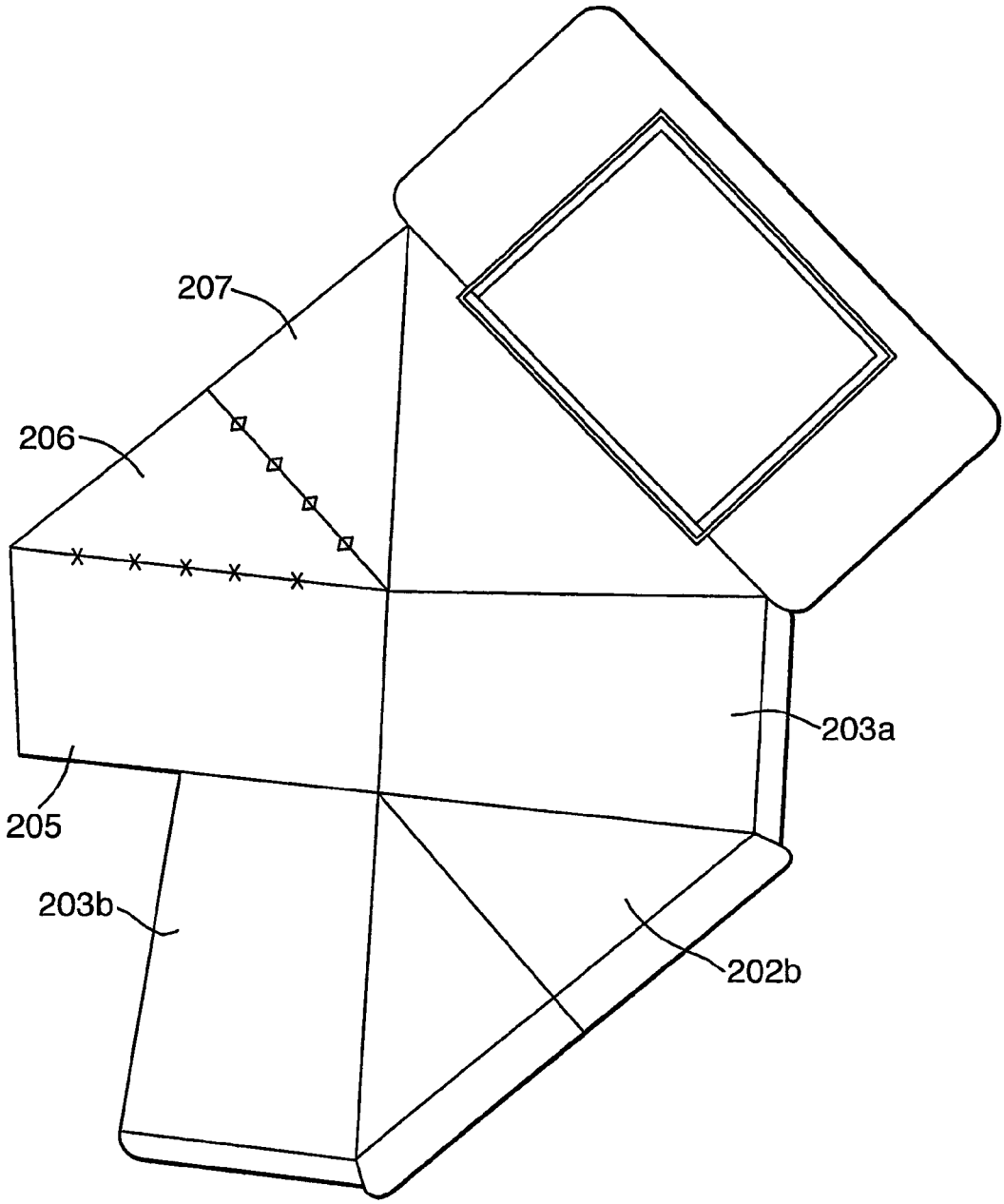
FIG. 18 is a plan view of a container according to a fourth embodiment.
Figure 19:
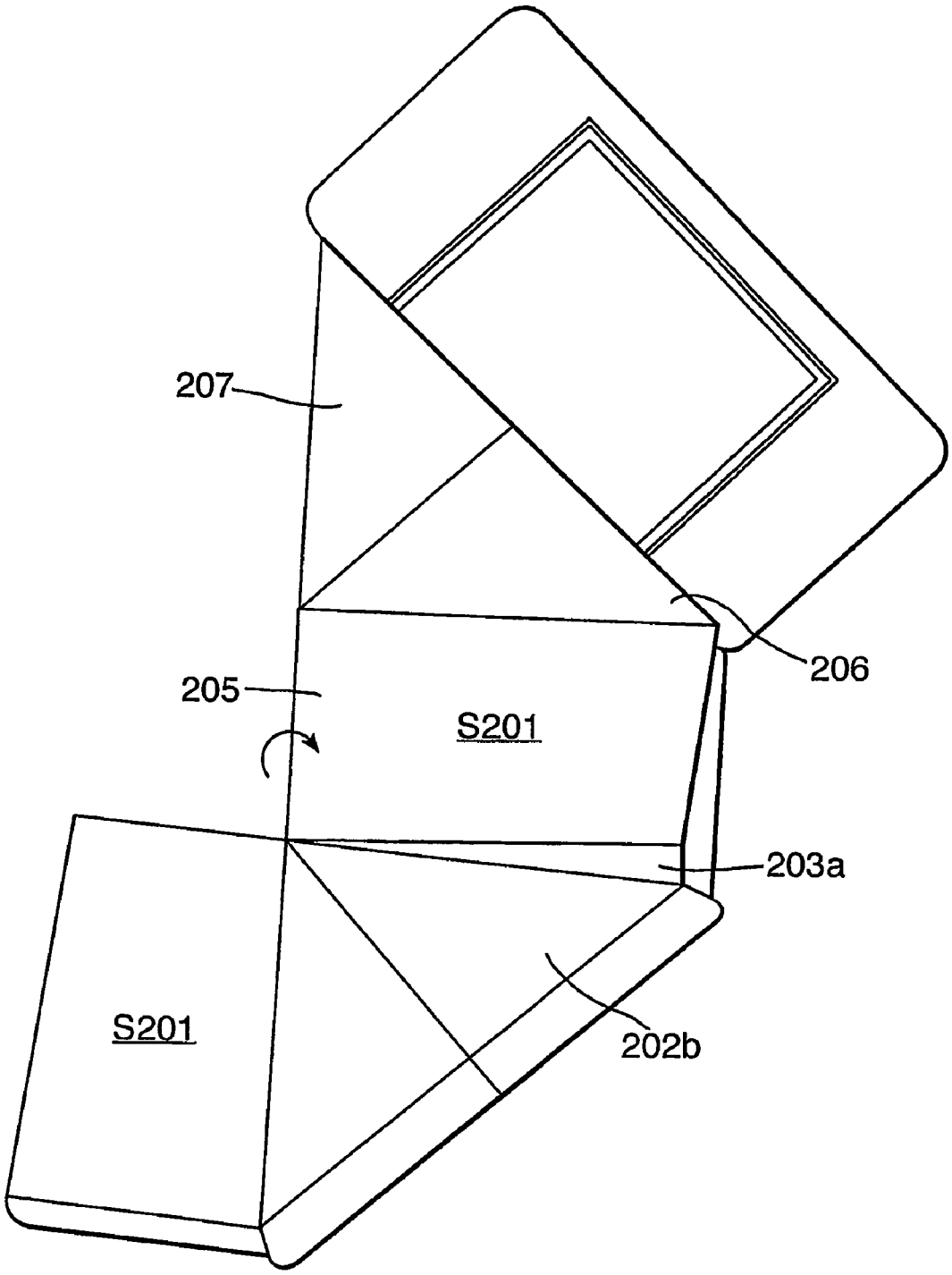
FIGS. 19, 20 and 21 are views of the blank shown in FIG. 18 in an intermediate stage of construction.
Figure 20:
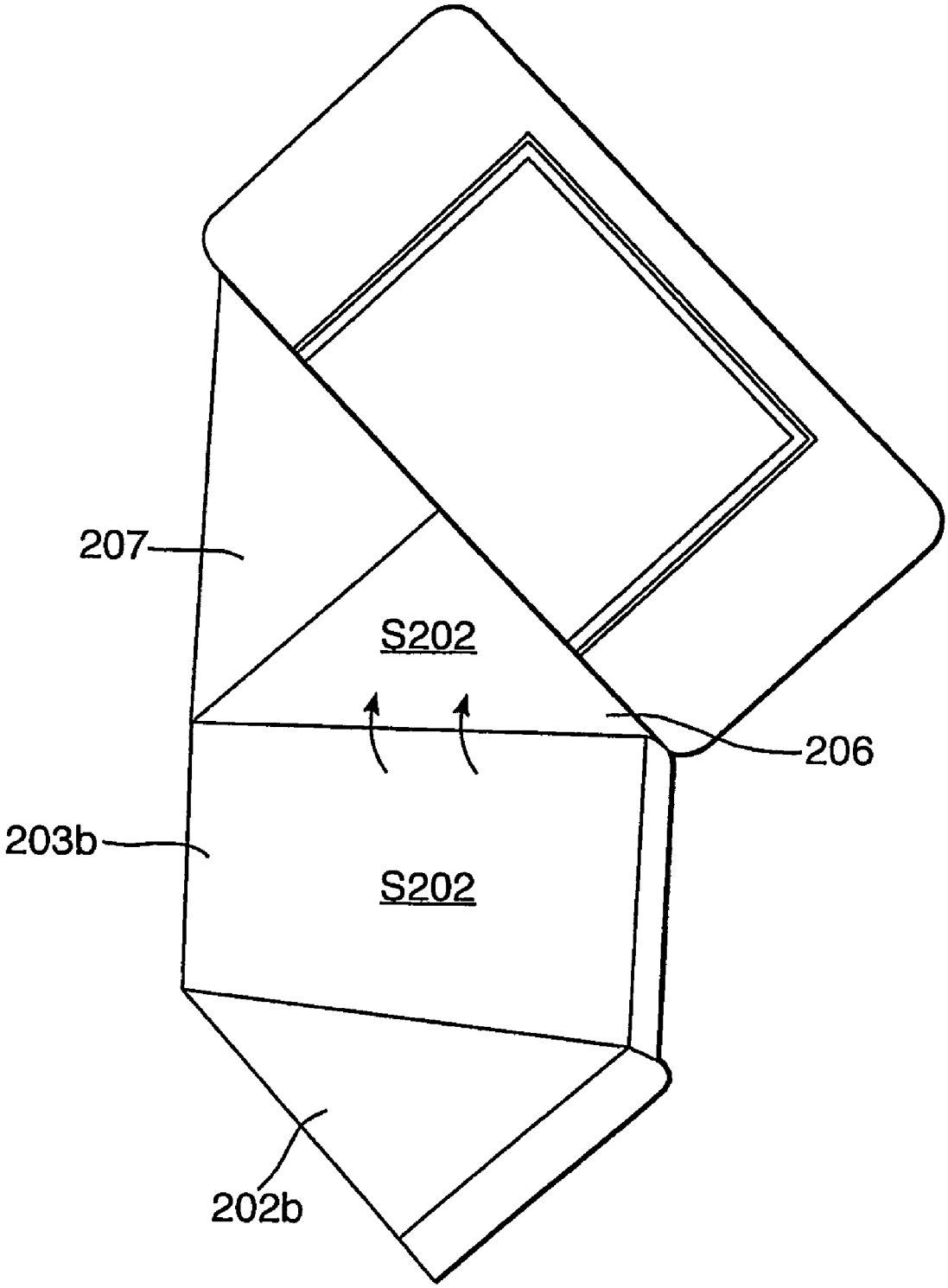
Figure 21:
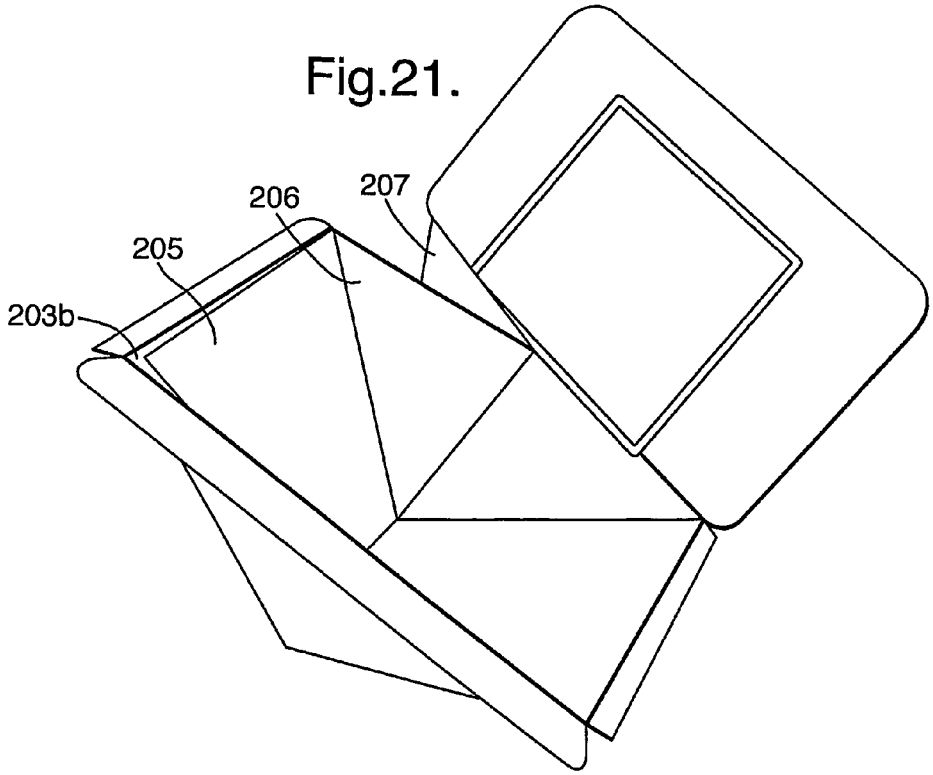
Figure 22:
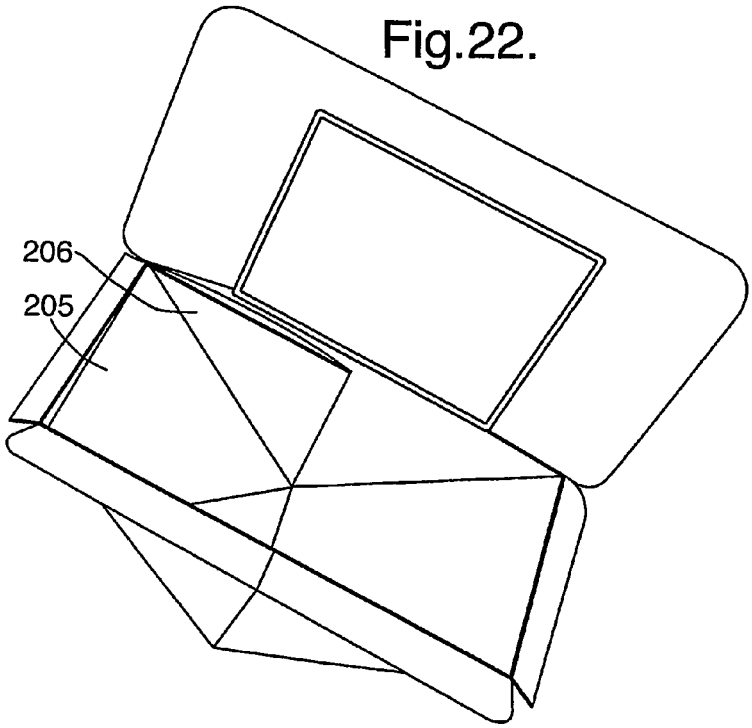
FIG. 22 is a perspective view of a partially assembled container in an erect configuration.

In the second embodiment shown in FIGS. 10, 11 and 12, and integral lid 10 is provided in place of the oral flap 8*d* adjacent side wall 2*a*. The lid is used to close the opening 9 in the finished container after the food product has been inserted. The lid 10 has an opening 11 which is covered by a transparent film 12 to enable the contents of the assembled container to be viewed after the peripheral end of the lid is sealed to the oral flange 8. The blank and container configuration allow the lid to be provided without a fold lines passing through the lid.

In the third and fourth embodiments shown in FIGS. 13 to 22, like parts are numbered in the same sequence as the first end second embodiments, but the sequencing starts at 100 rather than at 1 in the third embodiment, and 200 in the fourth embodiment.

It should be noted that, in contrast to the first and second embodiments, the fold line between the triangular central part or panel (106, 206) and the three sided part or panel (107, 207) in the third and fourth embodiments is a hill fold. This enables the hinge arrangement to be located internally in the erect container, and this modification could be applied to the first and second embodiments.

The construction of the third and fourth embodiments of the container involve the same steps, but the containers of these developments are particularly suited to a "pick and place" arrangement where the container is stored and shipped in a flat pack form, and then the construction finished at the site of the food producer by opening the container and securing the hinge arrangement. This second stage in the construction process of opening the container from a substantially flat condition and securing the hinge parts in secure abutment is well suited to automation. The hinge parts can be secured by an appropriate means such as gluing, heat sealing or RF welding.

A food product such as a sandwich can then be placed in the erected container by hand or by apparatus designed for that purpose, and the opening to the container closed and seal with a lid or suitable covering.

In the third embodiment, the hinge parts and the end wall provide a quadruple layer of paperboard, and this can be used as the base of the container to stop or slow down the egress of any moisture or liquid that might be contained in the sandwich. Also the construction of this development allows the hinge parts to lie within the container leaving four blank panels on which marketing information can be placed.

In the fourth embodiment, the hinge parts also lie within the container leaving four blank panels on which marketing information can be placed.

The invention is not restricted to the embodiments of the invention explicitly described herein, and modifications within the scope of the invention described in the claims will be apparent to the person skilled in the art. For example, references to sections of the blank being glued should be understood to encompass any form of fastening including RF welded by application of a suitable coating to the surfaces that are being joined.

The invention claimed is:

1. A partially assembled container for receiving a food product and formed from a partially fastened folded blank, the container having triangular side walls and substantially rectangular end walls to enable the formation of a generally triangular prism-shaped container with an opening for receiving the food product, wherein hinge means comprising a first hinge part hingedly connected to a second hinge part are provided between a first side wall and a first end wall to enable the partially assembled container to be moved between a substantially flat position for storage and transportation and a substantially erect position for receiving a food product, and wherein the hinge means additionally comprises a third hinge part hingedly connected to the second hinge part and rigidly connected to the first end wall such that the third hinge part is sandwiched by the first end wall and the second hinge part.

2. A partially assembled container as claimed in claim 1, wherein the first hinge part is hingedly connected to said first side wall, and the second hinge part is rigidly connected to said first end wall.

3. A partially assembled container as claimed in claim 2, wherein the first and second hinge parts lie in substantially the same plane when the container is in a substantially flat condition, and the first hinge part and said first end wall sandwich the second hinge part when the container is in a substantially erect condition.

4. A partially assembled container as claimed in claim 1, wherein the third hinge part and the surface of the first end wall to which it is connected are substantially congruent.

5. A partially assembled container as claimed in claim 1, wherein the hinge means are integral with said first side wall.

6. A partially assembled container as claimed in claim 1, wherein an integrally formed lid is provided for covering the opening in the container when it is in its erect condition.

7. A partially assembled container for receiving a food product and formed from a partially fastened folded blank, the container having triangular side walls and substantially rectangular end walls to enable the formation of a generally triangular prism-shaped container with an opening for receiving the food product, wherein hinge means comprising a first hinge part hingedly connected to a second hinge part are provided between a first one of said side wall and one of a first end wall to enable the partially assembled container to be moved between a substantially flat position for storage and transportation and a substantially erect position for receiving a food product, and wherein the hinge means additionally comprises a third hinge part hingedly connected to the second hinge part and rigidly connected to the said first end wall such that the third hinge part is sandwiched by the first end wall and the second hinge parts.

8. A partially assembled container as claimed in claim 7, wherein the first hinge part is hingedly connected to the first side wall, and the second hinge part is rigidly connected to said first end wall.

9. A partially assembled container as claimed in claim 8, wherein the first and second hinge parts lie in substantially the same plane when the container is in a substantially flat condition, and the first hinge part and the first end wall sandwich the second hinge part when the container is in a substantially erect condition.

10. A partially assembled container as claimed in claim 7, wherein the hinge means are integral with the first side wall.

11. A partially assembled container as claimed in claim 7, including integrally formed lid for covering the opening in the container when it is in its erect condition.

12. A method of forming a container from a blank having first and second triangular side walls and first and second substantially rectangular end walls to enable the formation of a generally triangular prism-shaped container with an opening for receiving the food product, the blank further comprising hinge means, the hinge means comprising a first hinge part hingedly connected to a second hinge part and arranged between a first side wall and a first end wall to enable a partially assembled container formed from the blank to be moved between a substantially flat position for storage and transportation and a substantially erect position for receiving a food product, the method comprising the following steps:

1) folding the hinge means to overlie at least the first side wall;
2) bringing the first end wall into abutment with the second end wall by folding the second side wall about a central fold line thereof;
3) folding the blank about the connection between the second end wall and the first side wall to bring part of the first end wall into abutment with the exposed surface of the second hinge part;
4) gluing the abutting surfaces of the second hinge part and the first end wall together to form a permanent join; and 6) pulling the first and second side walls in opposite directions such that the container naturally opens out into an erect state.

13. A method of forming a container from a blank having first and second triangular side walls and first and second substantially rectangular end walls to enable the formation of a generally triangular prism-shaped container with an opening for receiving the food product, the blank further comprising hinge means, the hinge means comprising a first hinge part hingedly connected to a second hinge part and arranged between a first side wall and a first end wall to enable a partially assembled container formed from the blank to be moved between a substantially flat position for storage and transportation and a substantially erect position for receiving a food product, wherein the hinge means additionally comprises a third hinge part hingedly connected to the second hinge part, wherein the third hinge part and the first end wall of the blank are substantially congruent, and wherein the hinge means are integral with the first side wall, the method comprising the following steps:

1) folding the hinge means to overlie the first side wall and the second end wall;
2) bringing the first end wall into abutment with the exposed surfaces of the third hinge part by folding the second side wall about a central fold line thereof;
3) gluing the abutting surfaces of the third hinge part and the first end wall together to form a permanent join;
4) folding the blank about the connection between the third hinge part and the second hinge part to bring part of the first end wall into abutment with the exposed surface of the second hinge part;
5) gluing the abutting surfaces of the second hinge part and the first end wall together to form a permanent join and thereby sandwich part of the first end wall between the third hinge part and the second hinge part; and
6) pulling the first and second side walls in opposite directions, such that the container naturally opens out into an erect state.

14. A method of forming a container from a blank having first and second triangular side walls and first and second substantially rectangular end walls to enable the formation of a generally triangular prism-shaped container with an opening for receiving the food product, the blank further comprising hinge means, the hinge means comprising a first hinge part hingedly connected to a second hinge part and arranged between a first side wall and a first end wall to enable a partially assembled container formed from the blank to be moved between a substantially flat position for storage and transportation and a substantially erect position for receiving a food product and wherein the hinge means additionally comprises a third hinge part hingedly connected to the second hinge part, the method comprising the following steps:

1) fastening the third hinge part to the inner surface of the first end wall and folding the partially fastened container into a substantially flat configuration;
2) storing the partially fastened container and transporting it to a food producer;
3) opening the partially fastened container; and
4) erecting the container by bringing the first and second hinge parts into abutment and fastening the hinge means in the abutting configuration ready for receipt of a food product.

* * * * *